US005379848A

United States Patent [19]

Rauser

[11] Patent Number: 5,379,848

[45] Date of Patent: Jan. 10, 1995

[54] DRILL HAMMER

[75] Inventor: Ulrich Rauser, Stuttgart, Germany

[73] Assignee: Robert Bosch GmbH, Stuttgart, Germany

[21] Appl. No.: 78,260

[22] PCT Filed: Oct. 17, 1992

[86] PCT No.: PCT/DE92/00873

§ 371 Date: Jun. 25, 1993

§ 102(e) Date: Jun. 25, 1993

[87] PCT Pub. No.: WO93/07995

PCT Pub. Date: Apr. 29, 1993

[30] Foreign Application Priority Data

Oct. 25, 1991 [DE] Germany ..... 4135240

[51] Int. Cl.[6] ..... B25D 11/04

[52] U.S. Cl. ..... 173/48; 173/109

[58] Field of Search ..... 173/48, 47, 109, 104, 173/201

[56] References Cited

U.S. PATENT DOCUMENTS

| | | | |
|---|---|---|---|
| 3,774,699 | 11/1973 | Schmuck | 173/48 |
| 3,837,409 | 9/1974 | Consoli et al. | 173/48 |
| 3,847,229 | 11/1974 | Wanner et al. | 173/48 |
| 4,066,136 | 1/1978 | Wanner et al. | 173/48 |
| 4,763,733 | 8/1988 | Neumaier | 173/48 |
| 4,895,212 | 1/1990 | Wache | 173/48 |

FOREIGN PATENT DOCUMENTS

| | | |
|---|---|---|
| 0331619 | 9/1989 | European Pat. Off. . |
| 0318480 | 3/1991 | European Pat. Off. . |
| 2146732 | 3/1973 | France . |
| 2218972 | 9/1974 | France . |
| 534036 | 2/1973 | Switzerland . |
| 8801219 | 2/1988 | WIPO . |

*Primary Examiner*—Scott A. Smith
*Attorney, Agent, or Firm*—Michael J. Striker

[57] ABSTRACT

A drill hammer has a housing, a rotary drive sleeve, a tool holder, a gear unit, a motor accommodated in the housing and transmitting its torque via the gear unit to the rotary drive sleeve and further to the tool holder, and a switch for switching from drilling operation to chisel operation and vice versa. The switch includes coupling members and an axially displaceable switching sleeve actuatable by an externally operated switch, and the coupling member is disengageable from the rotary drive sleeve by the switching sleeve against a spring force.

5 Claims, 2 Drawing Sheets

DRILL HAMMER

BACKGROUND OF THE INVENTION

The present invention relates to a drill hammer.

More particularly, it relates to a drill hammer which has a housing and a motor accommodated in the housing and transmitting its torque via a gear unit to a rotary drive sleeve and to a tool holder, and a switch is provided for switching from drilling operation to chisel operation and vice versa. A drill hammer which can be switched from drill operation to chisel operation is already known from EP 318 480 B2, but its switching device is not synchronized. This means that switching cannot be carried out with only one hand at the switch grip when the toothings to be engaged are positioned in such a way that one tooth faces another. Further, the switching sleeve is a difficult part to manufacture and is produced by precision casting with broached toothings, internal grinding, and hardening of the entire part.

SUMMARY OF THE INVENTION

Accordingly, it is an object of the present invention to provide a drill hammer of the above mentioned general type, which avoids the disadvantages of the prior art.

In keeping with these objects and with others which will become apparent hereinafter, one feature of the present invention resides, briefly stated, in a drill hammer which has the above specified elements and in which the switch has coupling members and an axially displaceable switching sleeve which can be acted upon by externally operated switching means, wherein in accordance with the invention, the coupling members can be disengaged by the switching sleeve against the force of a spring.

When the drill hammer is designed in accordance with the present invention, it has two main advantages over the prior art. On the one hand, the switch for changing from one type of operation to the other can be operated at any time with one hand and on the other hand manufacture of the switching parts is considerably simplified. In particular, the volume of the parts to be hardened is reduced. It is particularly advantageous that the sliding sleeve connected with the switching lever is not directly provided with teeth which must engage. Rather, the latter are arranged at separate, spring-loaded coupling parts. This also eliminates the need for a complete hardening of the entire sliding sleeve.

Advantageous further developments and improvements of the drill hammer are made possible by further steps. In particular, the switching sleeve is advantageously constructed as a toothless sliding sleeve. The retaining ring follows the axial movement of the sliding sleeve as the result of spring force as soon as the internal toothing arranged at the retaining ring can engage in the external toothing at the rotary drive sleeve. The retaining ring is secured against rotation in the circumferential direction relative to the gear casing, e.g. by a pin, so as to lock the rotary drive sleeve in such a way that it is fixed with respect to relative rotation in chisel operation. Synchronized switching to rotary operation is achieved by means of a spring-loaded toothed gear wheel which engages in the associated external toothing at the rotary drive sleeve when the sliding sleeve is in the appropriate position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
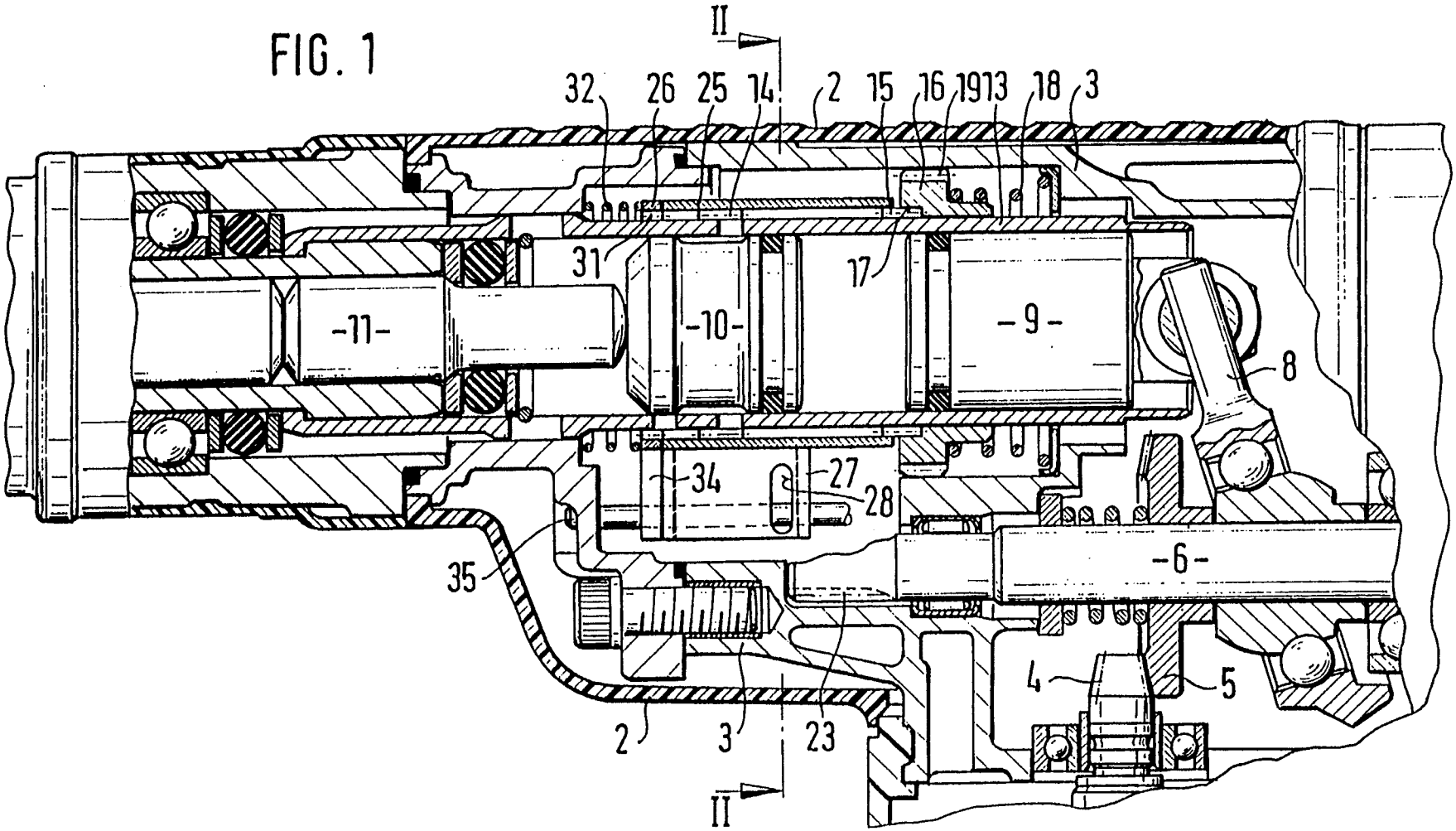
FIG. 1 shows a longitudinal section through a drill hammer.

The drill hammer which is shown in section has a housing 2 in which a gear casing 3 is inserted chiefly in the rear portion. The two housing parts 2, 3 can also be constructed as one piece. Further, a motor, not visible in the drawing, with motor pinion 4 is accommodated in the lower part of the housing 3. The motor pinion 4 meshes with a bevel gear wheel 5 supported on an intermediate shaft 6. A wobble drive 8, known per se, which drives a piston 9 in reciprocating motion is arranged on the intermediate shaft 6 at the rear. The piston 9 drives a beater 10 via an air cushion. The beater 10 acts on an anvil 11 which in turn transmits the blows to a drill or chisel tool. The piston 9 and beater 10 are guided in a tube which simultaneously serves as a rotary drive sleeve 13. The latter transmits the rotational movement to the tool holder which is not shown in more detail in the drawing. The rotary drive sleeve 13 carries a discontinuous external toothing which includes two portions 14, 15 but can also be constructed in one piece. A toothed gear wheel 16 engages with the external toothing 15 as a coupling part. For this purpose the toothed gear wheel 16 has an internal toothing 17 extending along a part of its axial length. A spring 18 which is supported against the rear part of the gear casing 3 acts on the side of the toothed gear wheel 17 remote of the internal toothing 17. The spring 18 is constructed as a spiral pressure spring, but may be constructed in any other manner as well, so as to exert a pressing force on the toothed gear wheel 16 in the direction of the toothing 15.

Figure 2:
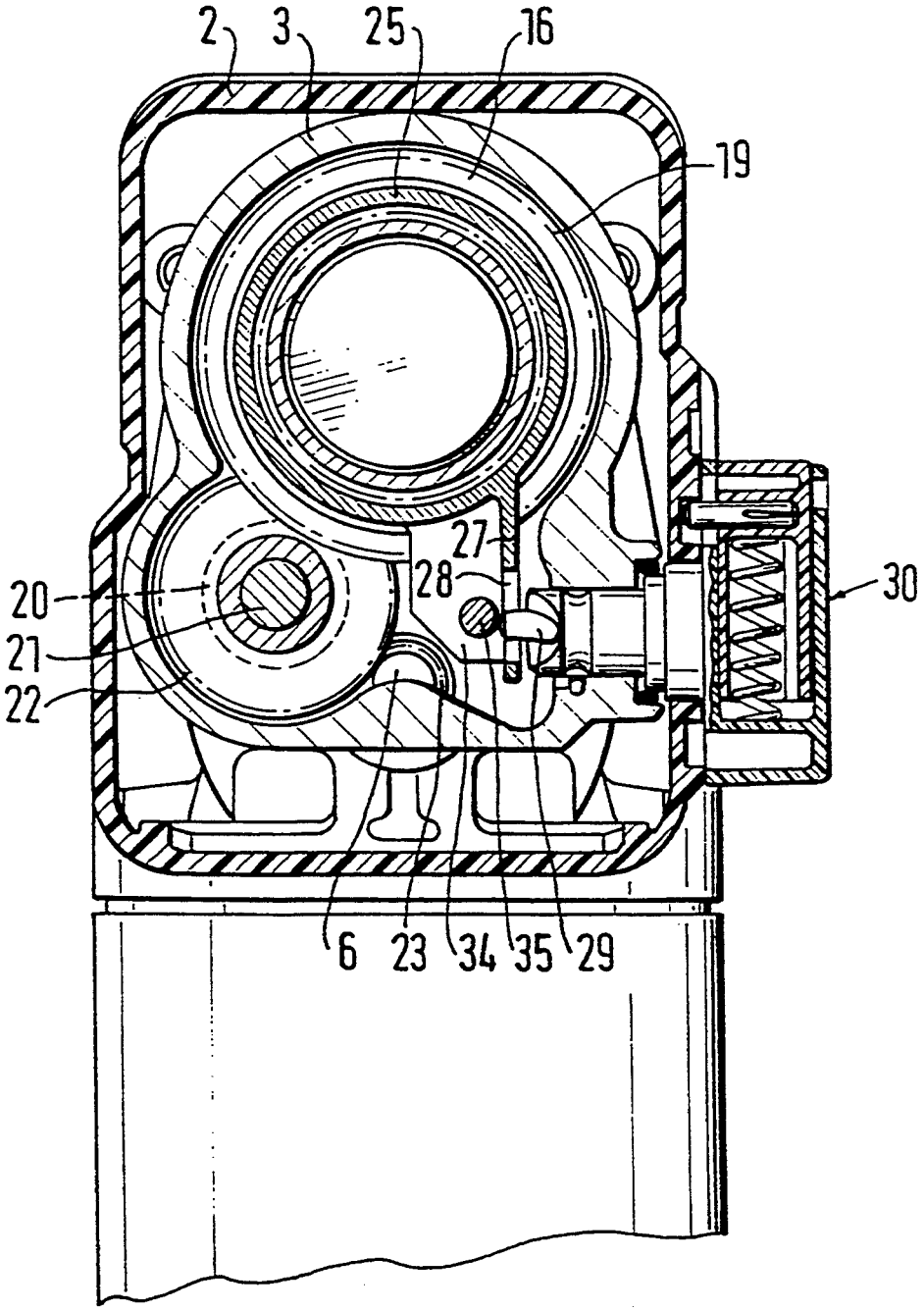
FIG. 2 shows a cross section according to line II—II in FIG. 1.

The toothed gear wheel 16 carries another toothing 19 at its circumference, which toothing 19 meshes with a toothed gear wheel 20 on a secondary shaft 21; the toothed gear wheel 20 is only suggested in FIG. 2. The secondary shaft 21 carries a second toothed gear wheel 22 which meshes with an end toothing 23 at the front end of the intermediate shaft 6.

An axial switching sleeve having two parts, a sliding sleeve 25 and a retaining ring 26, is arranged around the rotary drive sleeve 13. The two parts are arranged coaxially relative to the rotary drive sleeve 13 and adjoin one another. The sliding sleeve 25 serves as a switching member for the axial displacement of the toothed gear wheel 16 and retaining ring 26. It is longer than the external toothing 15 shown in FIG. 1 by at least half the length of the axial switching path, but can also be shorter than in the embodiment example. The sliding sleeve 25 has a downwardly directed continuation or projection 27 having an opening 28 for the engagement of an eccentric stud 29 at a switching means 30, particularly a rotation lever (compare FIG. 2). The projection 27 is preferably hardened in the region of the opening 28, the tubular principle part of the sliding sleeve 25 can remain soft. The retaining ring 26 has an internal toothing 31 corresponding to the external toothing 14. It is pressed against the sliding sleeve 25 by the force of a spring 32 supported against a step in the front part of the gear casing 3. The retaining ring 26 likewise has a tab 34 which projects downward approximately radially and is fixed relative to the gear casing 3 by a pin 35 arranged coaxial to the retaining ring. The pin 35 is held at both sides in the front part of the gear casing 3 and also extends through the projection 27 of the sliding sleeve 25.

The operation-changing switch, in its entirety, includes the following parts: rotation lever 30, sliding sleeve 25, toothings 14, 15, 17 and 31, toothed gear wheel 16, retaining ring 26, and the two springs 18 and 32. The end faces of the sliding sleeve 25 strike against the associated end faces of the toothed gear wheel 16 and retaining ring 26 during the switching movements. This allows high manufacturing tolerances in the millimeter range in the sliding sleeve 25 as well as considerable hardening distortion without impairment of function. Also, in contrast to the known solutions, a tilting of the sliding sleeve 25 due to the eccentric attack of the stud 29 is not harmful, since no toothing need be found.

FIG. 1 shows the hammer in percussion drilling operation, i.e. the toothed gear wheel 16 which is continuously driven by the toothed gear wheel 20 is coupled, via the toothings 17, 15, with the rotary drive sleeve 13 so as to be fixed with respect to rotation relative thereto. For chisel operation, the sliding sleeve 25 is displaced by the switching lever 30 toward the right in its axial direction, as seen in FIG. 1, up to the toothed gear wheel until the toothings 15, 17 disengage. This switches off the rotary drive. The rotary drive sleeve 13 and accordingly the tool holder are freely rotatable relative to the housing of the hammer and relative to the motor. To fix a determined rotational position of the tool holder relative to the housing 2, e.g. when using flat chisels, the rotation lever 30 is rotated further so that the switching sleeve 25 at least partially exposes the external toothing 14 on the rotary drive sleeve 13 and no longer covers it. The retaining ring 26 follows due to the force of the spring 31 of the sliding sleeve 25 and is likewise displaced to the right. The toothings 14 and 31 mesh immediately when in a favorable position. However, in a tooth-on-tooth position, the rotation lever 30 can still be rotated completely into the desired end position and engagement is effected after a slight rotation of the rotary drive sleeve 13 when starting the hammer. In so doing, the spring 32 forces the retaining ring 26 against the toothing 14.

This is effected in the reverse sense when switching from chisel operation to rotary percussion operation. The sliding sleeve 25 is displaced to the left, away from the toothed gear wheel 16. The pressure spring 18 pushes the toothed gear wheel 16 on the toothing 17 so that it is coupled with the rotary drive sleeve 13 so as to be fixed with respect to rotation relative to it. Also in this case, if the teeth of the toothings 15, 17 strike against one another a slight rotation of the rotary drive sleeve 13 causes the toothings to engage.

It will be understood that each of the elements described above, or two or more together, may also find a useful application in other types of constructions differing from the types described above.

While the invention has been illustrated and described as embodied in a drill hammer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A drill hammer, comprising a housing; a rotary drive sleeve having a toothing; a tool holder; a gear unit including a gear wheel engageable with said toothing of said rotary drive sleeve; a torque delivering motor accommodated in said housing and transmitting said torque via said gear wheel of said gear unit and said toothing of said rotary drive sleeve to said rotary drive sleeve and further to said tool holder; switching means for switching from drilling operation to chisel operation and vice versa, said switching means including a sliding sleeve axially displaceable relative to said rotary drive sleeve by an externally operated switch, said gear wheel of said gear unit being disengageable from said toothing of said rotary drive sleeve by said sliding sleeve against a spring acting on said gear wheel in a first direction; a retaining ring axially displaceable relative to said rotary drive sleeve and being acted upon by an additional spring, said additional spring exerting a pressing force on said retaining ring in direction opposite to said first direction, said retaining ring being secured against rotation relative to said housing and carrying a toothing engageable with a corresponding toothing of said rotary drive sleeve.

2. A drill hammer as defined in claim 1, wherein said housing includes a gear casing, said retaining ring being secured against rotation in a circumferential direction relative to said gear casing.

3. A drill hammer as defined in claim 1, wherein said sliding sleeve is substantially unhardened.

4. A drill hammer as defined in claim 1, wherein said toothing of said rotary drive sleeve is formed as a external toothing composed of two axially spaced portions, said retaining ring having an internal toothing corresponding to said external toothing of at least one of said portions.

5. A drill hammer comprising a housing, a rotary drive sleeve; a gear unit; a motor accommodated in said housing and transmitting its torque via said gear unit to said rotary drive sleeve and further to said tool holder; a switch for switching from drilling operation to chisel operation and vice versa, said switch including coupling members and an axially displaceable switching sleeve actuatable by externally operated switching means, said coupling members including a toothed retaining ring, said switching sleeve being formed as a toothless sliding sleeve and is axially displaceable with said toothed retaining ring; a spring acting on said toothed retaining ring in a switching direction; and a further spring, said coupling members further including said rotary drive sleeve and a toothed gear wheel connected with said rotary drive sleeve, said sliding sleeve being displaceable towards said toothed gear wheel, said further spring exerting a force on said toothed gear wheel in a direction opposite to said switching direction and toward said sliding sleeve.

* * * * *